US010522108B2

(12) United States Patent
Deepala et al.

(10) Patent No.: US 10,522,108 B2
(45) Date of Patent: Dec. 31, 2019

(54) OPTIMIZED HISTOGRAM READS FOR EFFICIENT DISPLAY POST PROCESSING AND IMPROVED POWER GAINS

(71) Applicant: QUALCOMM Incorporated, San Diego, CA (US)

(72) Inventors: Venkata Nagarjuna Sravan Kumar Deepala, Hyderabad (IN); Raviteja Tamatam, Hyderabad (IN); Jayant Shekhar, Hyderabad (IN); Sravan Kumar Ambapuram, Hyderabad (IN)

(73) Assignee: QUALCOMM Incorporated, San Diego, CA (US)

( * ) Notice: Subject to any disclaimer, the term of this patent is extended or adjusted under 35 U.S.C. 154(b) by 15 days.

(21) Appl. No.: 15/986,965

(22) Filed: May 23, 2018

(65) Prior Publication Data

US 2019/0362686 A1 Nov. 28, 2019

(51) Int. Cl.
*G09G 5/00* (2006.01)
*G09G 3/34* (2006.01)

(52) U.S. Cl.
CPC ..... *G09G 5/003* (2013.01); *G09G 3/3406* (2013.01); *G09G 2310/04* (2013.01); *G09G 2320/029* (2013.01); *G09G 2330/021* (2013.01)

(58) Field of Classification Search
CPC ..... G09G 5/003; G09G 2330/021; G09G 2320/029; G09G 2310/04; G09G 3/3406
See application file for complete search history.

(56) References Cited

U.S. PATENT DOCUMENTS 9,274,715 B2 * 3/2016 Chun ..... G11C 29/42
2008/0100598 A1 * 5/2008 Juenger ..... G09G 5/36 345/204
2008/0204481 A1 * 8/2008 Mostinski ..... G09G 3/3406 345/690
2010/0020886 A1 * 1/2010 Raveendran ..... H04N 5/144 375/240.27
2010/0134503 A1 * 6/2010 Sampsell ..... G09G 3/3466 345/522
2011/0063203 A1 * 3/2011 Hong ..... G09G 3/3406 345/102
2014/0104243 A1 * 4/2014 Sakariya ..... G06F 3/14 345/204
2015/0109286 A1 * 4/2015 Verbeure ..... G09G 3/3406 345/419

(Continued)

*Primary Examiner* — Yu Chen
(74) *Attorney, Agent, or Firm* — Holland & Hart LLP

(57) ABSTRACT

Methods, systems, and devices for refreshing a display of a device are described. A device may identify a type of content to be displayed. For example, the type of content may be associated with a given application. The device may determine, based at least in part on the type of content, a periodicity for a histogram analysis operation for the display. The device may then perform the histogram analysis operation according to the periodicity. For example, the device may compare a histogram for a frame of the content to a scene change threshold according to the periodicity. The device may determine one or more pixel adjustment parameters for the display based at least in part on the histogram analysis operation. The device may display one or more frames on the display based at least in part on the one or more pixel adjustment parameters.

17 Claims, 10 Drawing Sheets

(56) References Cited

U.S. PATENT DOCUMENTS

| | | | | |
|---|---|---|---|---|
| 2016/0078798 | A1* | 3/2016 | Watanabe | G09G 3/2007<br>345/690 |
| 2016/0111047 | A1* | 4/2016 | Yamato | G09G 3/3406<br>345/102 |

* cited by examiner

300

OPTIMIZED HISTOGRAM READS FOR EFFICIENT DISPLAY POST PROCESSING AND IMPROVED POWER GAINS

BACKGROUND

The following relates generally to refreshing a display of a device, and more specifically to histogram reads for efficient display post processing and improved power gains.

The display of a device may be updated periodically (e.g., at a rate of sixty frames per second for some video applications) or aperiodically (e.g., in response to some user input). Updating the display may involve transferring pixel values from a host processor of the device to a display panel of the device. For example, the host processor may perform various processing operations (e.g., layer composition) to determine the pixel values, which may consume power. The transfer of pixel values from the host processor to the display panel may consume bitwidth of a system bus of the device or otherwise negatively impact the device (e.g., by consuming power). In some cases, the transferred pixel values within a given frame (e.g., or across multiple frames) may also contain some level of redundancy. By way of example, some pixels may vary only slightly (e.g., or not at all) between successive frames. Improved techniques for updating a display in consideration of such redundancies may be desired.

SUMMARY

The described techniques relate to improved methods, systems, devices, and apparatuses that support histogram reads for efficient display post processing and improved power gains. Generally, the described techniques provide for identifying cases where the variance in content between frames is definite (e.g., within a threshold defined by post-processing algorithms). The described techniques achieve performance benefits (e.g., power cost reductions) by optimizing the reading and processing of histograms associated with the frames, thereby reducing the power costs associated with these features. For example, the described techniques may provide for determining a periodicity of the histogram analysis operations (e.g., where the periodicity may be based in part on the frame content variance). Periodically performing the histogram analysis operation (e.g., once every N frames) may provide power reductions compared to performing the histogram analysis operation for every frame.

A method of refreshing a display of a device is described. The method may include identifying a type of content to be displayed by the device, determining, based on the type of content, a periodicity for a histogram analysis operation for the display, performing the histogram analysis operation according to the periodicity, determining one or more pixel adjustment parameters for the display based on the histogram analysis operation, and displaying one or more frames on the display based on the one or more pixel adjustment parameters.

An apparatus is described. The apparatus may include a processor, memory in electronic communication with the processor, and instructions stored in the memory. The instructions may be executable by the processor to cause the apparatus to identify a type of content to be displayed by the apparatus, determine, based on the type of content, a periodicity for a histogram analysis operation for the display, perform the histogram analysis operation according to the periodicity, determine one or more pixel adjustment parameters for the display based on the histogram analysis operation, and display one or more frames on the display based on the one or more pixel adjustment parameters.

Another apparatus is described. The apparatus may include means for identifying a type of content to be displayed by the apparatus, determining, based on the type of content, a periodicity for a histogram analysis operation for the display, performing the histogram analysis operation according to the periodicity, determining one or more pixel adjustment parameters for the display based on the histogram analysis operation, and displaying one or more frames on the display based on the one or more pixel adjustment parameters.

A non-transitory computer-readable medium storing code for refreshing a display of a device is described. The code may include instructions executable by a processor to identify a type of content to be displayed by the device, determine, based on the type of content, a periodicity for a histogram analysis operation for the display, perform the histogram analysis operation according to the periodicity, determine one or more pixel adjustment parameters for the display based on the histogram analysis operation, and display one or more frames on the display based on the one or more pixel adjustment parameters.

Some examples of the method, apparatuses, and non-transitory computer-readable medium described herein may further include operations, features, means, or instructions for determining a scene change rate for the type of content by analyzing a set of histograms, each histogram associated with a respective frame of the type of content, where the periodicity of the histogram analysis operation may be based on the scene change rate.

In some examples of the method, apparatuses, and non-transitory computer-readable medium described herein, identifying the type of content may include operations, features, means, or instructions for identifying an application associated with the type of content in a list of applications, where each application in the list of applications may be associated with a respective periodicity of the histogram analysis operation.

Some examples of the method, apparatuses, and non-transitory computer-readable medium described herein may further include operations, features, means, or instructions for generating the list of applications and the respective periodicities by analyzing a set of histograms for each application in the list of applications.

In some examples of the method, apparatuses, and non-transitory computer-readable medium described herein, the type of content includes first pixels that change between adjacent frames and second pixels that do not change between the adjacent frames, the first pixels being smaller in quantity than the second pixels.

In some examples of the method, apparatuses, and non-transitory computer-readable medium described herein, performing the histogram analysis operation according to the periodicity may include operations, features, means, or instructions for reading a frame from a driver of the display according to the periodicity, generating a histogram for the frame and comparing the histogram for the frame to a scene change threshold, where the one or more pixel adjustment parameters may be determined based on the comparison.

Some examples of the method, apparatuses, and non-transitory computer-readable medium described herein may further include operations, features, means, or instructions for determining the scene change threshold based on the type of content, where comparing the histogram for the frame to the scene change threshold may be based on determining the scene change.

In some examples of the method, apparatuses, and non-transitory computer-readable medium described herein, generating the histogram for the frame may include operations, features, means, or instructions for generating a spread of brightness values for pixels of the frame and determining a representative value for the frame based on the spread of brightness values, where comparing the histogram for the frame to the scene change threshold may include operations, features, means, or instructions for comparing the representative value for the frame to the scene change threshold.

In some examples of the method, apparatuses, and non-transitory computer-readable medium described herein, determining the one or more pixel adjustment parameters may include operations, features, means, or instructions for identifying the one or more pixel adjustment parameters based on comparing the histogram for the frame to the scene change threshold and passing the one or more pixel adjustment parameters to the driver of the display.

In some examples of the method, apparatuses, and non-transitory computer-readable medium described herein, the one or more pixel adjustment parameters include a backlight reduction value, a pixel boosting value, a pixel intensity value, a pixel reduction value, or a combination thereof.

In some examples of the method, apparatuses, and non-transitory computer-readable medium described herein, the periodicity spans a group of frames that may be associated with the type of content.

DETAILED DESCRIPTION

Figure 1:
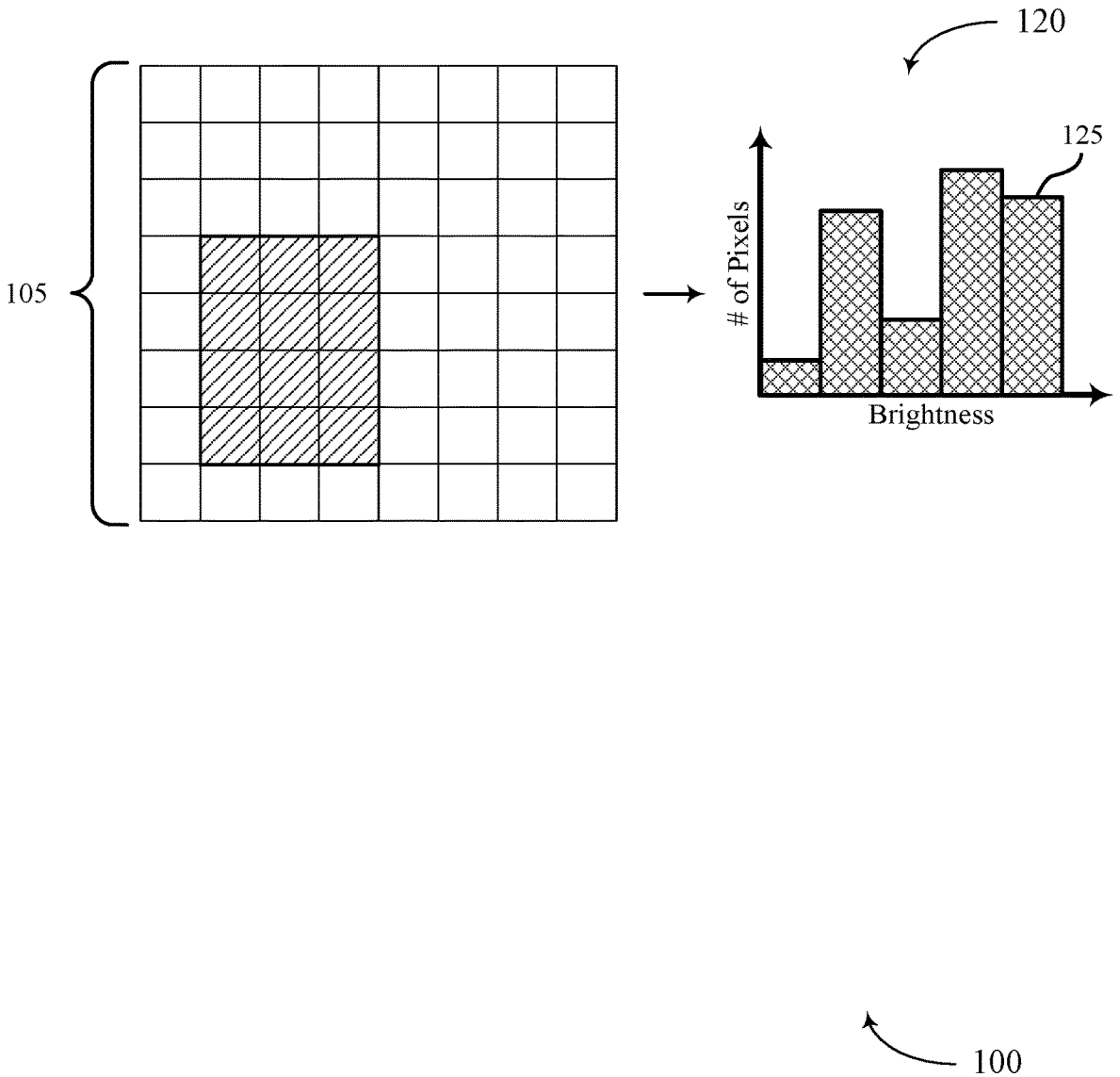
FIG. 1 illustrates an example of a frame analysis operation for refreshing a display of a device that supports histogram reads for efficient display post processing and improved power gains in accordance with aspects of the present disclosure.

The proposed techniques relate to refreshing a display of a device (e.g., a camera, a wireless device such as a smartphone, tablet, wearable, or the like). The display may contain an array of pixels that is refreshed as the content to be displayed changes over time. The refresh operation may include a host processor transferring a refreshed array of pixels to a display panel, which may subsequently display the refreshed array of pixels. In some cases, redundant pixel information may exist within a single frame or across multiple frames. By way of example, a single frame may contain a constant color block, in which a block of pixels may be defined by a single color tuple. Similarly, temporally adjacent frames may vary slightly (e.g., some regions may not vary between frames).

Some display operations may be supported based at least in part on content histogram-based display post processing features. For example, such features may reduce power consumption for mobile devices with a liquid-crystal display (LCD), a light-emitting diode (LED) display, an organic LED (OLED), or the like. Examples of such histogram-based features include content adaptive backlight (CABL) adjustment for LCD panels and fidelity optimized signal scaling (FOSS) for OLED panels. CABL may, for example, include backlight reduction and/or pixel boosting (e.g., by applying a pixel mapping look-up table (LUT)) while FOSS may include pixel modification. By reducing the panel backlight values and/or compensating by applying a LUT, power saving may be achieved for LCD panels. Similarly, by optimizing the displayed pixel intensities (e.g., and achieving an optimal visual experience), power saving may be achieved for OLED panels.

Such features (e.g., CABL, FOSS, etc.) may be based on reading a content histogram from hardware (e.g., a display pipeline) whenever there is a frame update. The histogram data may be passed through post-processing algorithms (e.g., proprietary algorithms), which algorithms may analyze the scene changes and identify transitions. In the case of a transition, the algorithms may program new pixel adjustment parameters (e.g., backlight values, LUT values, pixel boosting values, etc.) to the hardware drivers. For example, the transitions may be identified based on determining if the change in screen content is beyond a predefined (e.g., or dynamically determined) scene threshold.

In some cases, such post-processing features may thus have a scene threshold which is used to filter small changes on the screen from triggering a new convergence cycle. However, for each frame update on the screen (e.g., beyond the scene threshold), histogram read, histogram analysis, pixel adjustment parameter generation, and pixel adjustment parameter hardware configuration may be performed. Such operations may be associated with increased power consumption at a device. In accordance with aspects of the present disclosure, these operations may be performed according to a periodicity (e.g., once every N frame updates).

Aspects of the disclosure are initially described in the context of a frame analysis operation for refreshing a display at a display panel of a device. Aspects of the disclosure are then described in the context of display operations. Aspects of the disclosure are further illustrated by and described with reference to apparatus diagrams, system diagrams, and flowcharts that relate to inline pixel operations for displays.

FIG. 1 illustrates an example of a frame analysis operation 100. In some cases, frame analysis operation 100 may be performed for refreshing a display on a device. Frame analysis operation 100 includes pixel array 105, which may be generated in a variety of ways in accordance with the present disclosure. In some cases, pixel array 105 may be generated by a graphics processing unit (GPU) of a device.

For example, the GPU may generate (e.g., or be involved in generating) a pixel array 105 for each frame in a sequence of frames (e.g., by performing one or more rendering operations to generate set of layers). A host processor of the device (e.g., which may refer to the GPU or some other processor of the device) may then transfer the pixel array 105 to a display panel of the device. For example, the GPU may perform various rendering operations to generate pixel array 105 (e.g., or portions thereof), while the host processor may perform composition of various layers rendered by the GPU (e.g., which composition may alternatively be referred to as blending).

A display panel may generally refer to a screen (e.g., a display) as well as one or more components modulating the content that appears on the screen. Examples of such components include liquid crystals, plasma, light-emitting diodes, and the like. In some cases, a display panel may additionally be associated with hardware supporting the content modulation. Examples are provided below in the context of a display panel controller, which may serve to complement the operations of the GPU and/or host processor.

In some cases pixel array 105 may change (e.g., significantly) from one frame to the next. For example, if a device is displaying a video stream, the pixel array 105 may vary between frames (e.g., may form completely different images from one frame to another). However, in some cases, pixel array 105 may be less volatile from one frame to another. For example, pixel array 105 may in some cases be described in the context of variable pixels 110 and constant pixels 115. Constant pixels 115 may refer to pixels which vary slightly (e.g., or not at all) between frames, while variable pixels 110 may refer to pixels which exhibit a wider range of variation between frames.

It is to be understood that pixel array 105 is illustrated for the sake of explanation and may in some cases represent a simplified example of a frame. For example, although pixel array 105 contains one region of variable pixels 110, it is to be understood that pixel array 105 may contain any suitable number of such regions without deviating from the scope of the present disclosure. Additionally, while variable pixels 110 are illustrated as a rectangle, it is to be understood that in some cases the shape of variable pixels 110 may be another regular shape (e.g., an octagon) or irregular shape without deviating from the scope of the present disclosure.

Aspects of the present disclosure relate to identifying use cases for histogram reads and refreshing displays based on the histogram reads. An example of such a case may be provided in the context of a video stream where the content change between adjacent frames is limited (e.g., definite), but where the accumulated content change from non-adjacent frames may go up to the maximum area of the display (e.g., message editing, maps, video games, notepads, readers). Another such case may be provided in the context of a video stream where the content change between any two frames (e.g., adjacent or non-adjacent frames) is restricted to a fraction of the area of the display (e.g., call screens, scroll screens, stop watch, compass, a television remote). For example, in the context of a stop watch application, variable pixels 110 may correspond to the timer itself while constant pixels 115 may correspond to the background and navigation buttons (e.g., which may remain constant while the timer runs).

As illustrated, pixel array 105 may in some cases be associated with a histogram 120 comprising a number of bins 125. For example, each bin 125 may correspond to a respective brightness value (e.g., a value ranging from 0 to 255), and the height of each bin 125 may correspond to the number of pixels in pixel array 105 having that brightness value. In accordance with aspects of the present disclosure (e.g., for use cases where the amount of change is limited and within the scene threshold limits), a device may omit the histogram 120 read and analysis after a first convergence cycle (e.g., or may limit the frequency at which the histogram 120 read and analysis is performed). That is, the post-processing algorithms which look for frame updates and perform histogram 120 analysis may be suspended (e.g., for a given amount of time, until a scene change is detected, etc.). The rate at which histogram 120 is processed may in some cases be based at least in part on a type of content contained in pixel array 105. For example, if the type of content corresponds to a stop watch, the periodicity of the histogram analysis operation may be infinite (e.g., because it is unlikely that any changes in variable pixels 110 would trigger a new convergence cycle even if the histogram 120 were analyzed by the post-processing algorithms).

Processing histogram 120 may include analyzing the spread of pixel values across bins 125 (e.g., and comparing with the spread of a previously generated histogram). For example, the spread of pixel values may be represented as a value (e.g., a regression from the mean), and these values may be compared across pixel arrays 105. Additionally or alternatively, the comparison may be based on discrepancies between corresponding bins 125 of different histograms 120. These examples are not limiting of scope, and other techniques for identifying discrepancies are considered without deviating from the scope of the present disclosure. Based on discrepancies in the spread profiles (e.g., compared to a scene change threshold), the device may determine whether to trigger a new convergence cycle (e.g., which may refer to generation of backlight values or other pixel adjustment parameters).

Limiting the number of histogram 120 analysis operations may benefit a device in terms of power consumption (e.g., without impacting display performance). Techniques for identifying use cases which may benefit from aspects of the present disclosure are discussed herein (e.g., with reference to FIG. 4). Similarly, techniques for maintaining display performance in accordance with the power reduction considerations are discussed herein.

Figure 2:
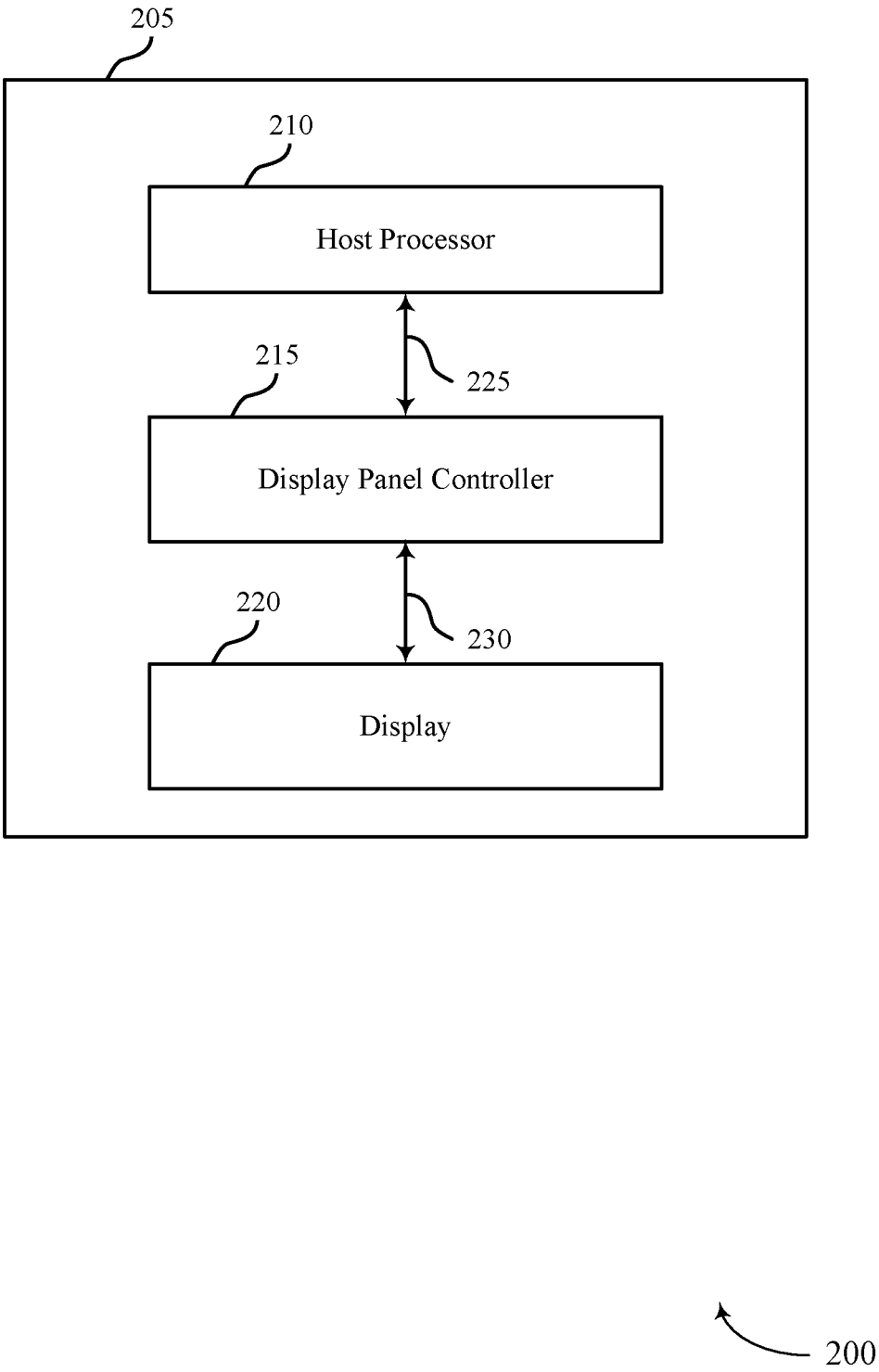
FIG. 2 illustrates a block diagram of a device that supports histogram reads for efficient display post processing and improved power gains in accordance with aspects of the present disclosure.

FIG. 2 illustrates block diagram 200 of a device 205 that supports histogram reads for efficient display post processing and improved power gains in accordance with aspects of the present disclosure. Device 205 includes a host processor 210, a display panel controller 215, and a display 220. In some cases, display panel controller 215 may alternatively be referred to as display pipeline hardware. Host processor 210 and display panel controller 215 may communicate via link 225 (e.g., a display serial interface (DSI) link) while display panel controller 215 may communicate with display 220 via link 230. It is to be understood that in some cases link 225 and link 230 may refer to a same link (e.g., a link related to a system bus).

As discussed herein, host processor 210 may in some cases be referred to as a GPU or may otherwise be involved in layer composition. For example, host processor 210 may include or support the execution of processing algorithms described herein, a hardware overlay composer (e.g., which may decide a composition strategy), and a display driver (e.g., a kernel driver used to program the display pipeline hardware). Aspects of host processor 210 are described with reference to FIG. 3.

In some cases, host processor 210 may represent a means for performing various aspects of the present disclosure. For example, host processor 210 may represent means for identifying a type of content to be displayed, means for determining a periodicity for a histogram analysis operation, means for performing the histogram analysis operation (e.g., in conjunction with display controller 215), and means for determining one or more pixel adjustment parameters for the display. For example, such techniques may be performed by hardware associated with host processor 210, software stored on host processor 210, etc. Host processor 210 may additionally or alternatively act as means for performing other aspects of the present disclosure including (but not limited to) means for determining a scene change rate for a given type of content by analyzing a plurality of histograms, means for identifying an application associated with the given type of content in a list of applications, means for reading a frame, means for generating a histogram for the frame, and means for comparing the histogram for the frame to a scene change threshold. Additionally or alternatively, display panel controller 215 may represent means for reading the frame and/or means for generating a histogram for the frame. Similarly, display panel controller 215 may represent means for updating display 220, which may in turn represent a means for displaying one or more frames based at least in part on the one or more pixel adjustment parameters.

In some examples, aspects of the present disclosure relate to limiting the number of histogram analysis operations performed by host processor 210. For example, each histogram analysis operation may include host processor 210 reading a histogram (e.g., histogram 120) from hardware (e.g., from display panel controller 215), processing the histogram (e.g., to detect a scene change), and generating one or more pixel adjustment parameters (e.g., in the case of a new convergence cycle being triggered by the scene change).

Host processor 210 may program display panel controller 215 (e.g., via link 225) with each new set of pixel adjustment parameters. Thus, in some cases host processor 210 may refer to (e.g., or store) software used to configure display panel controller 215. Display panel controller 215 may update display 220 (e.g., by communicating pixel array 105 over link 230). In some cases, display panel controller 215 may generate multiple frames for display 220 based at least in part on the set of pixel adjustment parameters. Display panel controller 215 may be responsible for layer composition, frame timing, one or more post-processing operations, blending of layers, fetching, or the like.

By limiting the number of histogram reads and processing operations performed by host processor 210, aspects of the present disclosure may support power reductions and more efficient operations for device 205. Additionally or alternatively, aspects of the present disclosure may support reducing the bitwidth of information communicated over link 225 or otherwise reduce the processing load on device 205, improve the performance of device 205, etc.

Figure 3:
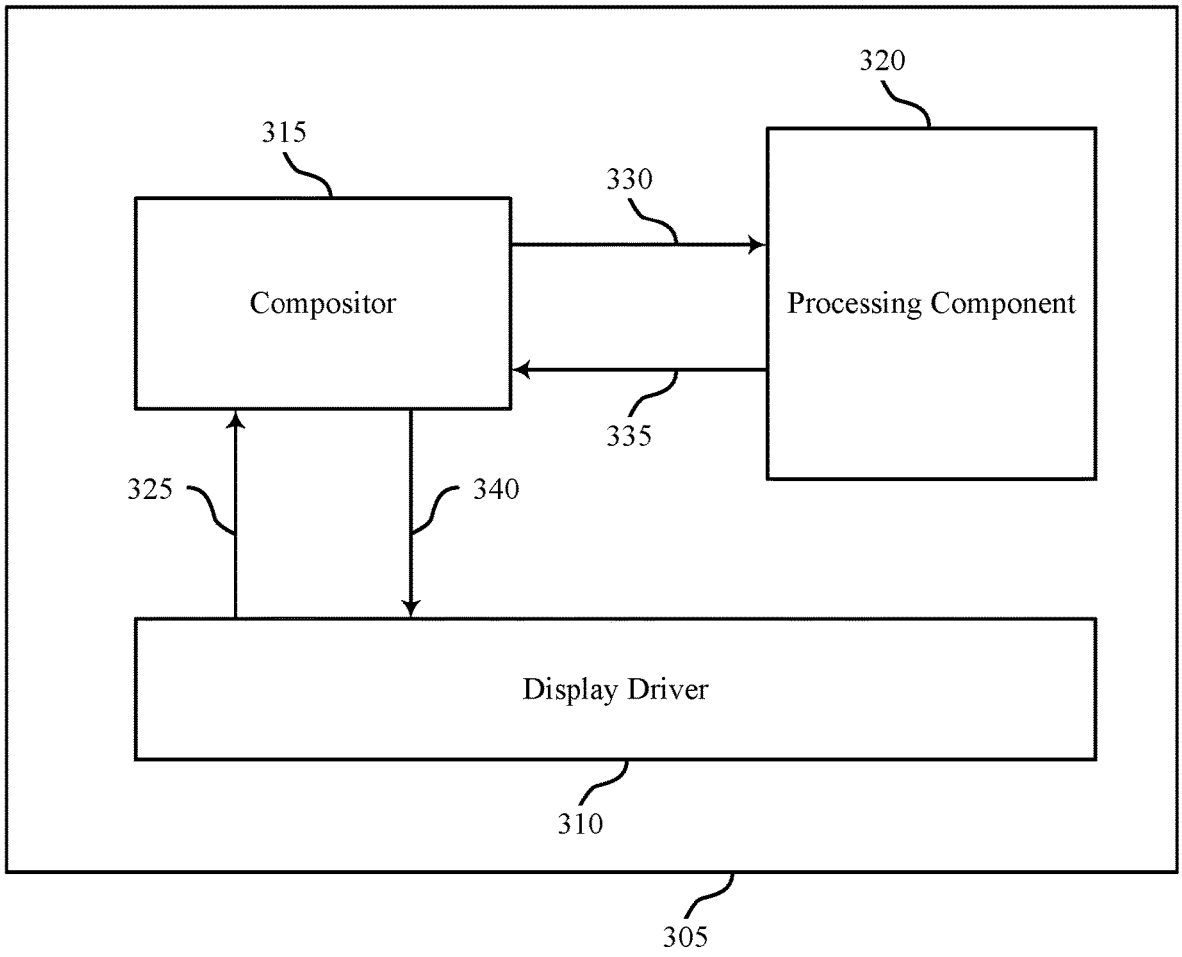
FIG. 3 illustrates a block diagram of a host processor that supports histogram reads for efficient display post processing and improved power gains in accordance with aspects of the present disclosure.

FIG. 3 illustrates a block diagram 300 of host processor 305 that supports histogram reads for efficient display post processing and improved power gains in accordance with aspects of the present disclosure. Host processor 305 may be an example of host processor 210, host processor 610, or host processor 740. In some cases, host processor 305 may perform aspects of the procedures described below with reference to display panel controller 615.

Host processor 305 may include display driver 310, compositor 315, and processing component 320 (e.g., a component to execute processing algorithms, software stored on host processor 305, hardware integrated with host processor 305). Display driver 310 may alternatively be referred to as a kernel software driver and may in some cases interface with display pipeline hardware (e.g., with a display panel controller). A histogram read operation 325 may result in a histogram (e.g., generated by the display panel controller or by display driver 310) being passed from display driver 310 to compositor 315. Compositor 315 may alternatively be referred to as a hardware overlay composer and may be involved in determining a composition strategy (e.g., for rendering a pixel array).

In some cases, compositor 315 may perform a histogram analysis operation and pass the result 330 to processing component 320. For example, the histogram analysis operation may in some cases involve generating a representative value for the histogram or otherwise converting the information contained in the histogram to data usable by processing component 320. The histogram analysis operation may include analyzing the spread of pixel values (e.g., brightnesses, Luma values) for one (or more) frames. For example, the spread of pixel values may be represented as a scalar value (e.g., a regression from the mean), and these values may be compared for different frames. Additionally or alternatively, the histogram analysis operation may include comparing mean pixel values across different pixel arrays, median pixel values across the different pixel arrays, or other such comparisons. These examples are not limiting of scope, and other techniques for identifying discrepancies are considered without deviating from the scope of the present disclosure. That is, various techniques for contrasting histograms for different pixel arrays are considered within the scope of the present disclosure. Based on discrepancies in the spread profiles (e.g., compared to a scene change threshold), processing component 320 may determine whether to trigger a new convergence cycle (e.g., which may refer to generation of backlight values or other pixel adjustment parameters).

Processing component 320 may perform histogram analysis (e.g., by checking for a scene change). Processing component 320 may in some cases represent software stored on host processor 305. Additionally or alternatively, processing component 320 may represent hardware (e.g., an array of arithmetic logic units (ALUs), a field programmable gate array (FPGA), other equivalent integrated or discrete logic circuitry) for performing aspects of the present disclosure. For example, analysis may involve comparing result 330 to a scene change threshold (e.g., which may be a pre-configured value, a dynamically determined value). By way of example, result 330 may be a scalar value representing a spread of pixel values for a given pixel array, may be a vector (e.g., a vector comprising multiple scalar values such as a range, a median, a mean), or the like. Processing component 320 may in some cases compare result 330 to a result for a histogram previously generated by compositor 315 (e.g., a histogram for a prior frame) and any discrepancies between the results may be compared to the scene change threshold. Additionally or alternatively, result 330 may be compared directly to the scene change threshold (e.g., a dynamic scene change threshold) such that a large spread of pixel values, a high average pixel brightness, or the like triggers a new convergence cycle. In the case that a scene change is detected (e.g., based on a comparison), the processing algorithms may generate one or more pixel adjustment parameters 335, which may then be passed from compositor 315 to display driver 310 (e.g., in the form of a LUT write or backlight scale update 340). Aspects of the present disclosure relate to limiting the number of histogram read and analysis operations performed by host processor 305 for various use cases.

Figure 4:
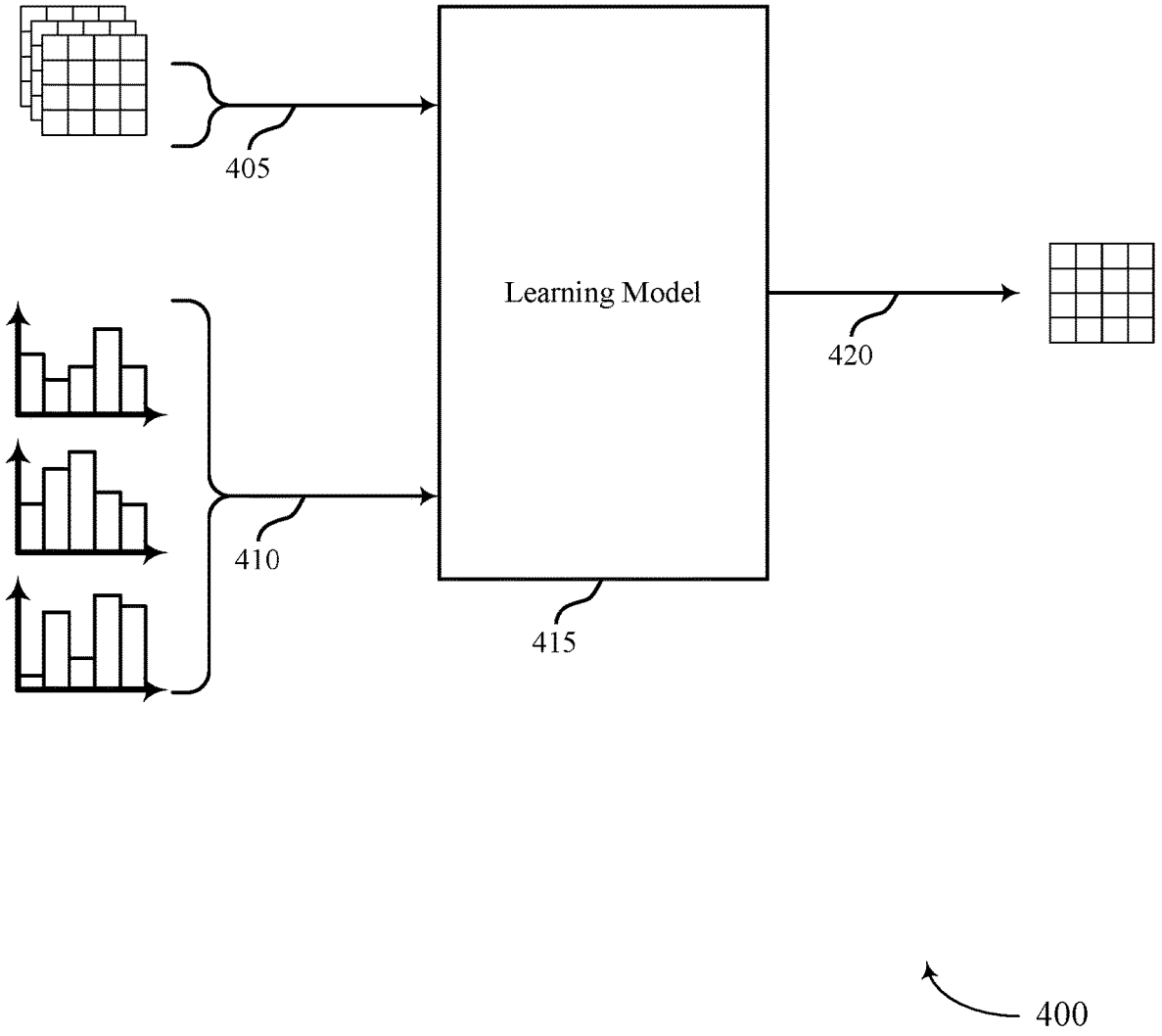
FIG. 4 illustrates an example of a training diagram that supports histogram reads for efficient display post processing and improved power gains in accordance with aspects of the present disclosure.

FIG. 4 illustrates an example of a training diagram 400 that supports histogram reads for efficient display post processing and improved power gains in accordance with aspects of the present disclosure. For example, training diagram 400 may be used to identify use cases (e.g., applications) which may benefit from efficient histogram analysis (e.g., as described with reference to FIG. 3). Aspects of training diagram 400 may be performed by a device (e.g., device 605) as described herein. Additionally or alternatively, aspects of training diagram 400 may be performed by a remote entity (e.g., in a simulation) and communicated to a device such as device 605.

Training diagram 400 illustrates a learning model 415, which may be developed to analyze histograms 410 of various pixel arrays 405. For example, each histogram 410 may correspond to a respective pixel array 405, and each pixel array 405 (e.g., or group of pixel arrays 405) may correspond to a respective type of application. By analyzing the histograms 410 and pixel arrays 405, learning model 415 may generate a table 420 (e.g., which may contain a content variance between pixel arrays 405 for a given use case and a corresponding histogram read frequency or periodicity for the given use case). For example, use cases in table 420 that are associated with a lower percentage content variance may be associated with a higher histogram read periodicity (e.g., because there may be a lower chance that the histogram triggers the scene change threshold for these use cases). As a specific example, for an in-call screen (e.g., where the content variance may be relatively low) may be associated with a relatively long histogram read periodicity (e.g., every sixty frames, every one-hundred frames, an infinite periodicity) while a video stream may be associated with a shorter periodicity (e.g., every frame, every other frame, every five frames) because the content variance (e.g., between adjacent frames) may be relatively high.

Additionally or alternatively, use cases benefiting from aspects of the present disclosure may be identified based on categorizing (e.g., white-listing) of such use cases. For example, such white-listing techniques may include aspects of training diagram 400, but the learning model associated with white-listing may be more closely supervised (e.g., by determining the amount of content change a frame can go through in any given use case and passing this amount as an input to various post-processing components). The performance results of various use cases may be tracked and the histogram read periodicity adjusted in various aspects of the white-listed applications. The white-listed use cases may comprise a list of applications (e.g., which may be wholly or partially communicated between devices) and associated histogram analysis periodicities. For example, the white-listed use cases may include a given application (e.g., a timer, an in-call screen, or the like) and an associated periodicity (e.g., every other frame, every one-hundred frames, etc.). When a device identifies that the application is in use, the device may determine a histogram analysis periodicity based on the white-listed use cases (e.g., based on a look-up table).

Figure 5:
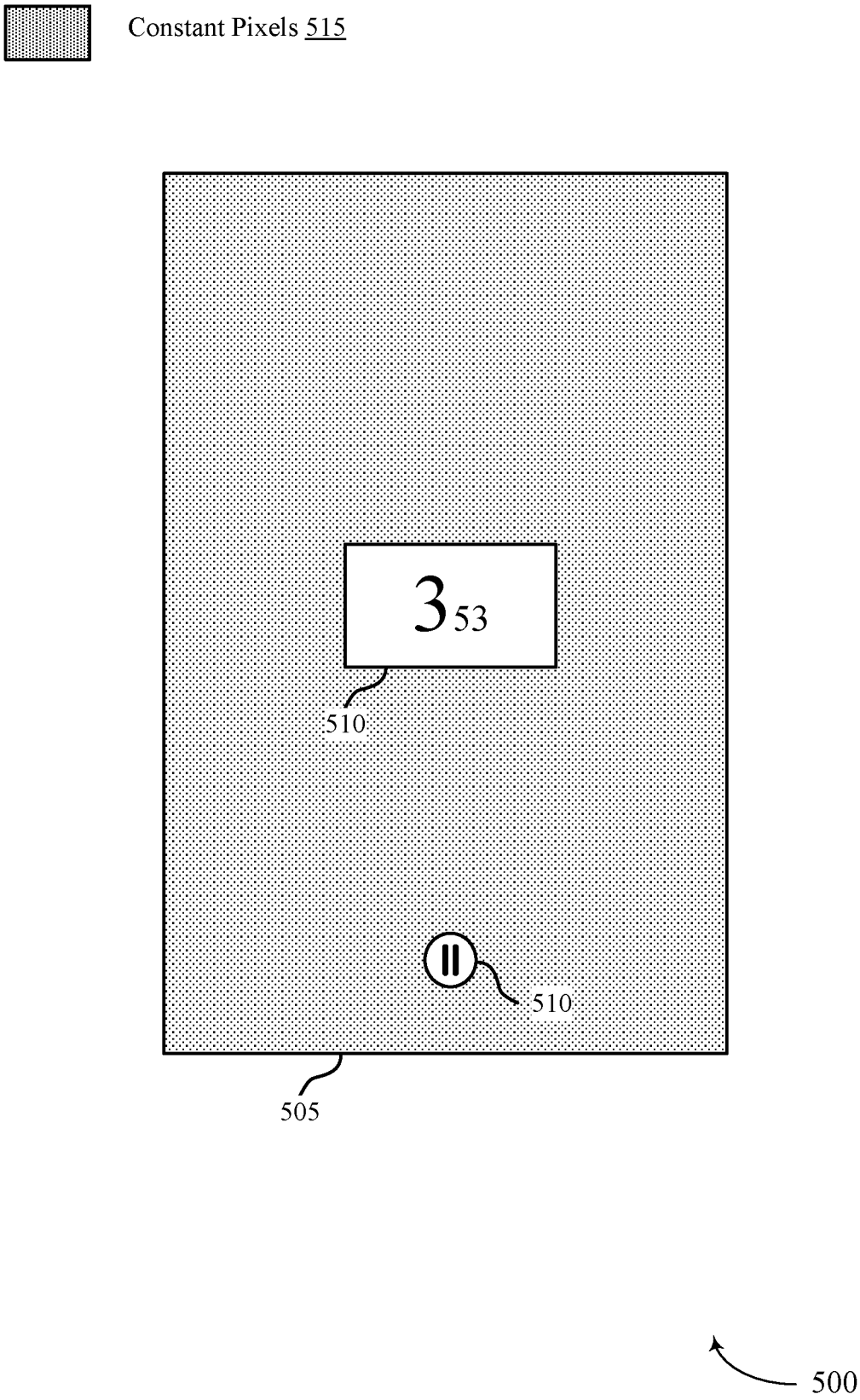
FIG. 5 illustrates an example of techniques that support histogram reads for efficient display post processing and improved power gains in accordance with aspects of the present disclosure.

FIG. 5 illustrates techniques associated with a use case 500 that supports histogram reads for efficient display post processing and improved power gains in accordance with aspects of the present disclosure. Use case 500 may, for example, represent a given application being executed on a device (e.g., a mobile device). The device may include a display 505 (e.g., a touch screen or the like), which may in turn comprise a plurality of pixels.

Use case 500 illustrates display 505 as showing a timer (e.g., running a timer application). When running the timer application, display 505 may comprise constant pixels 515 and variable pixels 510. Constant pixels 515 may, for example, represent or include a background for the application (e.g., an image, a constant color block) and one or more navigation icons (e.g., for navigating within the timer application, for returning to a home screen, or the like). Variable pixels 510 may represent regions of display 505 which can change during the application. As illustrated, the variable pixels 510 may comprise a relatively small portion of the area of display 505 (e.g., compared to the constant pixels 515). Because the variable pixels 510 comprise a small portion of display 505, the chances of a new convergence cycle being triggered between different frames of the timer application may be relatively small. Accordingly, the device may identify (e.g., based on a learning model, a look-up table, etc.) a histogram analysis periodicity for the timer application, which may be based on a quantity of variable pixels 510, constant pixels 515, other factors, or a combination thereof. For example, increasing the periodicity for the timer application may benefit the device (e.g., in terms of power consumption).

Figure 6:
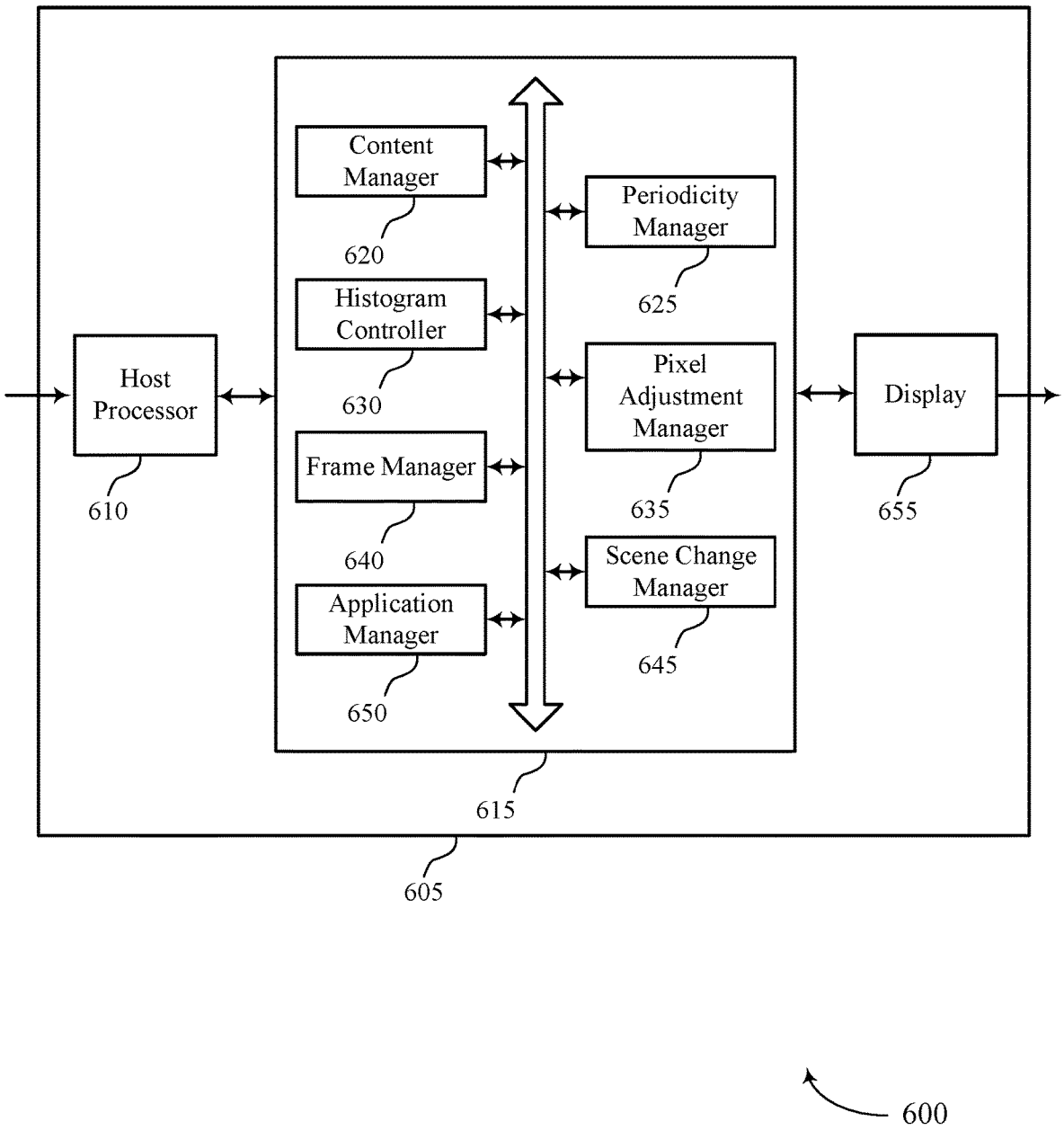
FIG. 6 shows a block diagram of a device that supports histogram reads for efficient display post processing and improved power gains in accordance with aspects of the present disclosure.

FIG. 6 shows a block diagram 600 of a device 605 that supports histogram reads for efficient display post processing and improved power gains in accordance with aspects of the present disclosure. The device 605 may include a host processor 610, a display panel controller 615, and a display 655. Each of these components may be in communication with one another (e.g., via one or more buses).

Host processor 610 may be or include a digital signal processor (DSP), general purpose microprocessor, application specific integrated circuit (ASIC), FPGA, or other equivalent integrated or discrete logic circuitry. Host processor 610 may execute one or more software applications. Examples of the applications may include operating systems, word processors, web browsers, e-mail applications, spreadsheets, video games, audio and/or video capture, playback or editing applications, or other such applications that initiate the generation of image data to be presented via display 655.

The display panel controller 615, and/or at least some of its various sub-components, may be implemented in hardware, code (e.g., software or firmware) executed by a processor, or any combination thereof. If implemented in code executed by a processor, the functions of the display panel controller 615, and/or at least some of its various sub-components may be executed by a general-purpose processor, a DSP, an ASIC, an FPGA or other programmable logic device, discrete gate or transistor logic, discrete hardware components, or any combination thereof designed to perform the functions described in the present disclosure. Aspects of the operations described below with reference to the components of display panel controller 615 may alternatively be performed by host processor 610 (e.g., as described with reference to FIG. 3) without deviating from the scope of the present disclosure.

The display panel controller 615, and/or at least some of its various sub-components, may be physically located at various positions, including being distributed such that portions of functions are implemented at different physical locations by one or more physical components. In some examples, the display panel controller 615, and/or at least some of its various sub-components, may be a separate and distinct component in accordance with various aspects of the present disclosure. In some examples, the display panel controller 615, or its sub-components, may be combined with one or more other hardware components, including but not limited to an input/output (I/O) component, a transceiver, a network server, another computing device, one or more other components described in the present disclosure, or a combination thereof in accordance with various aspects of the present disclosure.

The display panel controller 615 may include a content manager 620, a periodicity manager 625, a histogram controller 630, a pixel adjustment manager 635, a frame manager 640, a scene change manager 645, and an application manager 650. Each of these modules may communicate, directly or indirectly, with one another (e.g., via one or more buses).

The content manager 620 may identify a type of content to be displayed by the device. In some cases, the type of content includes first pixels that change between adjacent frames and second pixels that do not change between the adjacent frames, the first pixels being smaller in quantity than the second pixels.

The periodicity manager 625 may determine, based on the type of content, a periodicity for a histogram analysis operation for the display. In some cases, the periodicity spans a group of frames that is associated with the type of content.

The histogram controller 630 may perform the histogram analysis operation according to the periodicity. In some examples, the histogram controller 630 may read a frame from a driver of the display according to the periodicity. In some examples, the histogram controller 630 may generate a histogram for the frame. In some examples, the histogram controller 630 may compare the histogram for the frame to a scene change threshold, where the one or more pixel adjustment parameters are determined based on the comparison. In some examples, the histogram controller 630 may generate a spread of brightness values for pixels of the frame. In some examples, the histogram controller 630 may determine a representative value for the frame based on the spread of brightness values, where comparing the histogram for the frame to the scene change threshold includes comparing the representative value for the frame to the scene change threshold.

The pixel adjustment manager 635 may determine one or more pixel adjustment parameters for the display based on the histogram analysis operation. In some examples, the pixel adjustment manager 635 may identify the one or more pixel adjustment parameters based on comparing the histogram for the frame to the scene change threshold. In some examples, the pixel adjustment manager 635 may pass the one or more pixel adjustment parameters to the driver of the display. In some cases, the one or more pixel adjustment parameters include a backlight reduction value, a pixel boosting value, a pixel intensity value, a pixel reduction value, or a combination thereof. The frame manager 640 may display one or more frames on the display based on the one or more pixel adjustment parameters.

The scene change manager 645 may determine a scene change rate for the type of content by analyzing a set of histograms, each histogram associated with a respective frame of the type of content, where the periodicity of the histogram analysis operation is based on the scene change rate. In some examples, the scene change manager 645 may determine the scene change threshold based on the type of content, where comparing the histogram for the frame to the scene change threshold is based on determining the scene change.

The application manager 650 may identify an application associated with the type of content in a list of applications, where each application in the list of applications is associated with a respective periodicity of the histogram analysis operation. In some examples, the application manager 650 may generate the list of applications and the respective periodicities by analyzing a set of histograms for each application in the list of applications.

Display 655 may represent a unit capable of displaying video, images, text or any other type of data for consumption by a viewer. Display 655 may include a LCD, a LED display, an OLED, an active-matrix OLED (AMOLED), or the like. In some cases, display 655 may be a component of (e.g., or otherwise controlled by) display panel controller 615.

Figure 7:
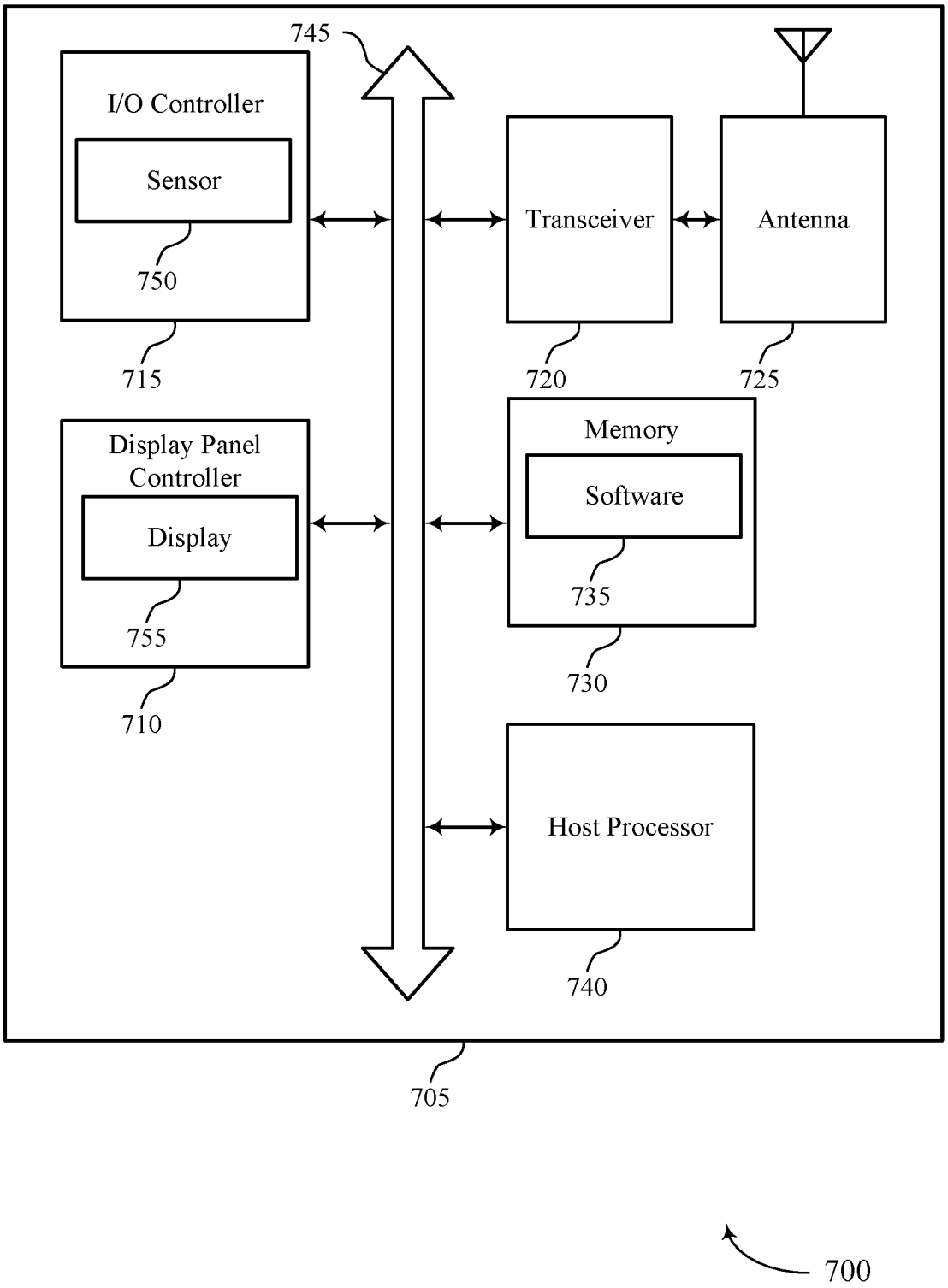
FIG. 7 shows a diagram of a system including a device that supports histogram reads for efficient display post processing and improved power gains in accordance with aspects of the present disclosure.

FIG. 7 shows a diagram of a system 700 including a device 705 that supports histogram reads for efficient display post processing and improved power gains in accordance with aspects of the present disclosure. The device 705 may be an example of or include the components of device 605. The device 705 may include components for bi-directional voice and data communications including components for transmitting and receiving communications. Device 705 may include a display panel controller 710 (e.g., which may include display 755), I/O controller 715, transceiver 720, antenna 725, memory 730, software 735, and host processor 740. These components may be in electronic communication via one or more buses (e.g., bus 745).

Host processor 740 may include an intelligent hardware device, (e.g., a general-purpose processor, a DSP, an ISP, a CPU, a GPU, a microcontroller, an ASIC, a FPGA, a programmable logic device, a discrete gate or transistor logic component, a discrete hardware component, or any combination thereof). In some cases, host processor 740 may be configured to operate a memory array using a memory controller. In other cases, a memory controller may be integrated into host processor 740. Host processor 740 may be configured to execute computer-readable instructions stored in a memory to perform various functions (e.g., functions or tasks supporting face tone color enhancement).

The I/O controller 715 may manage input and output signals for the device 705. The I/O controller 715 may also manage peripherals not integrated into the device 705. In some cases, the I/O controller 715 may represent a physical connection or port to an external peripheral. In some cases, the I/O controller 715 may utilize an operating system such as iOS®, ANDROID®, MS-DOS®, MS-WINDOWS®, OS/2®, UNIX®, LINUX®, or another known operating system. In other cases, the I/O controller 715 may represent or interact with a modem, a keyboard, a mouse, a touchscreen, or a similar device. In some cases, the I/O controller 715 may be implemented as part of a processor. In some cases, a user may interact with the device 705 via the I/O controller 715 or via hardware components controlled by the I/O controller 715. In some cases, I/O controller 715 may be or include sensor 750. Sensor 750 may be an example of a digital imaging sensor for taking photos and video.

The transceiver 720 may communicate bi-directionally, via one or more antennas, wired, or wireless links as described above. For example, the transceiver 720 may represent a wireless transceiver and may communicate bi-directionally with another wireless transceiver. The transceiver 720 may also include a modem to modulate the packets and provide the modulated packets to the antennas for transmission, and to demodulate packets received from the antennas. In some cases, the wireless device may include a single antenna 725. However, in some cases the device may have more than one antenna 725, which may be capable of concurrently transmitting or receiving multiple wireless transmissions.

Device 705 may participate in a wireless communications system (e.g., may be an example of a mobile device). A mobile device may also be referred to as a user equipment (UE), a wireless device, a remote device, a handheld device, or a subscriber device, or some other suitable terminology, where the "device" may also be referred to as a unit, a station, a terminal, or a client. A mobile device may be a personal electronic device such as a cellular phone, a personal digital assistant (PDA), a tablet computer, a laptop computer, or a personal computer. In some examples, a mobile device may also refer to an Internet-of-Things (IoT) device, an Internet-of-Everything (IoE) device, a machine type communication (MTC) device, or the like, which may be implemented in various articles such as appliances, vehicles, meters, or the like.

Memory 730 may comprise one or more computer-readable storage media. Examples of memory 730 include, but are not limited to, a random access memory (RAM), static RAM (SRAM), dynamic RAM (DRAM), a read-only memory (ROM), an electrically erasable programmable read-only memory (EEPROM), a compact disc read-only memory (CD-ROM) or other optical disc storage, magnetic disc storage, or other magnetic storage devices, flash memory, or any other medium that can be used to store desired program code in the form of instructions or data structures and that can be accessed by a computer or a processor. Memory 730 may store program modules and/or instructions that are accessible for execution by host processor 740. That is, memory 730 may store computer-readable, computer-executable software 735 including instructions that, when executed, cause the processor to perform various functions described herein. In some cases, the memory 730 may contain, among other things, a basic input/output system (BIOS) which may control basic hardware or software operation such as the interaction with peripheral components or devices. The software 735 may include code to implement aspects of the present disclosure, including code to support deep-learning-based color enhancement systems. Software 735 may be stored in a non-transitory computer-readable medium such as system memory or other memory. In some cases, the software 735 may not be directly executable by the processor but may cause a computer (e.g., when compiled and executed) to perform functions described herein.

Display panel controller 710 may represent a means for controlling display 755. Display panel controller 710 and/or at least some of its various sub-components may be implemented in hardware, software executed by a processor, firmware, or any combination thereof. If implemented in software executed by a processor, the functions of the display panel controller 710 and/or at least some of its various sub-components may be executed by a general-purpose processor, a DSP, an ASIC, an FPGA or other programmable logic device, discrete gate or transistor logic, discrete hardware components, or any combination thereof designed to perform the functions described in the present disclosure.

Display 755 represents a unit capable of displaying video, images, text or any other type of data for consumption by a viewer. Display 755 may include a LCD, a LED display, an OLED, an AMOLED, or the like. In some cases, display 755 and I/O controller 715 may be or represent aspects of a same component (e.g., a touchscreen) of device 705.

Figure 8:
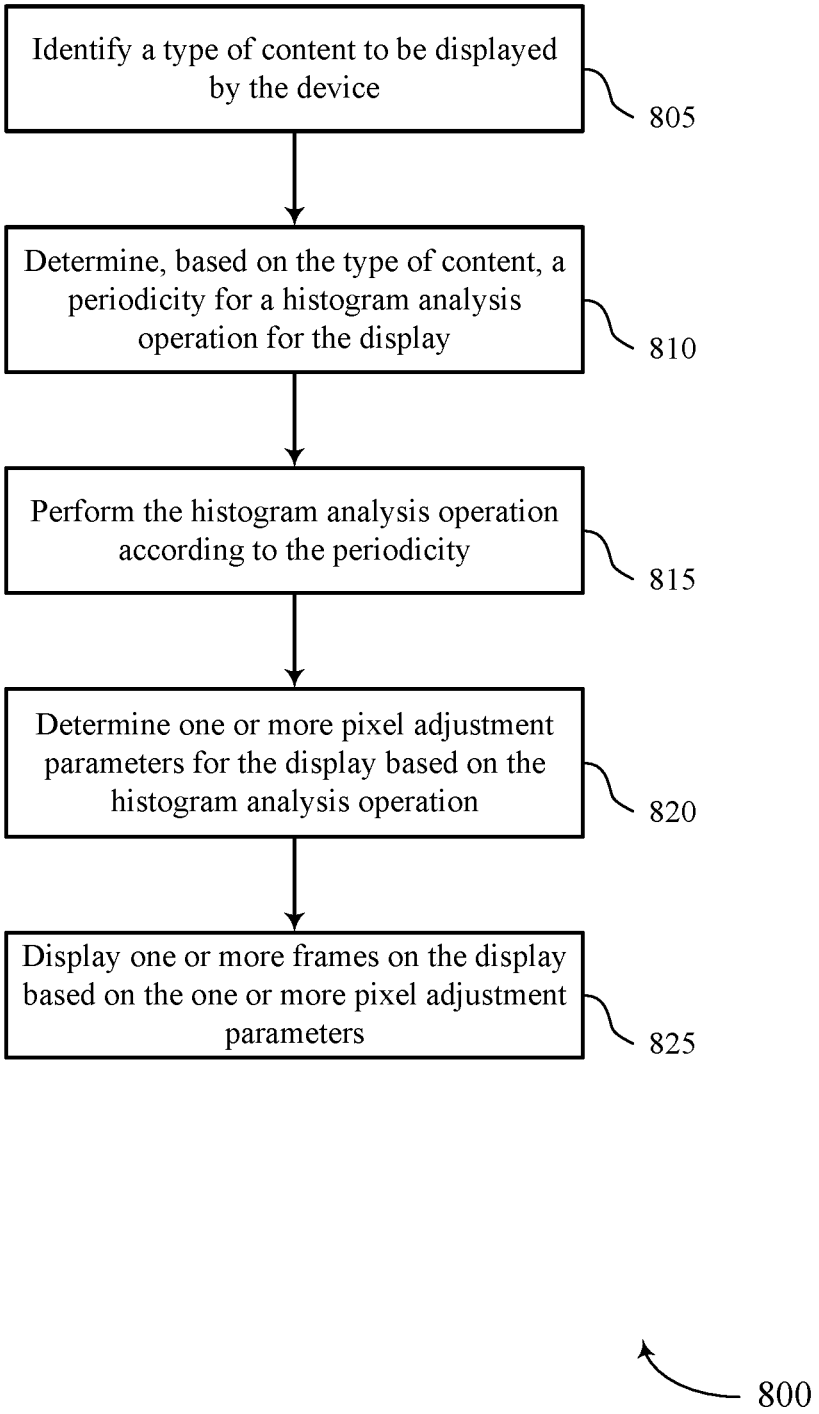
FIGS. 8 through 10 show flowcharts illustrating methods that support histogram reads for efficient display post processing and improved power gains in accordance with aspects of the present disclosure.

FIG. 8 shows a flowchart illustrating a method 800 that supports histogram reads for efficient display post processing and improved power gains in accordance with aspects of the present disclosure. The operations of method 800 may be implemented by a device or its components as described herein. For example, the operations of method 800 may be performed by a display panel controller as described with reference to FIGS. 6 and 7. In some examples, a device may execute a set of instructions to control the functional elements of the device to perform the functions described below. Additionally or alternatively, a device may perform aspects of the functions described below using special-purpose hardware.

At 805, the device may identify a type of content to be displayed by the device. The operations of 805 may be performed according to the methods described herein. In some examples, aspects of the operations of 805 may be performed by a content manager as described with reference to FIG. 6.

At 810, the device may determine, based on the type of content, a periodicity for a histogram analysis operation for the display. The operations of 810 may be performed according to the methods described herein. In some examples, aspects of the operations of 810 may be performed by a periodicity manager as described with reference to FIG. 6.

At 815, the device may perform the histogram analysis operation according to the periodicity. The operations of 815 may be performed according to the methods described herein. In some examples, aspects of the operations of 815 may be performed by a histogram controller as described with reference to FIG. 6.

At 820, the device may determine one or more pixel adjustment parameters for the display based on the histogram analysis operation. The operations of 820 may be performed according to the methods described herein. In some examples, aspects of the operations of 820 may be performed by a pixel adjustment manager as described with reference to FIG. 6.

At 825, the device may display one or more frames on the display based on the one or more pixel adjustment parameters. The operations of 825 may be performed according to the methods described herein. In some examples, aspects of the operations of 825 may be performed by a frame manager as described with reference to FIG. 6.

Figure 9:
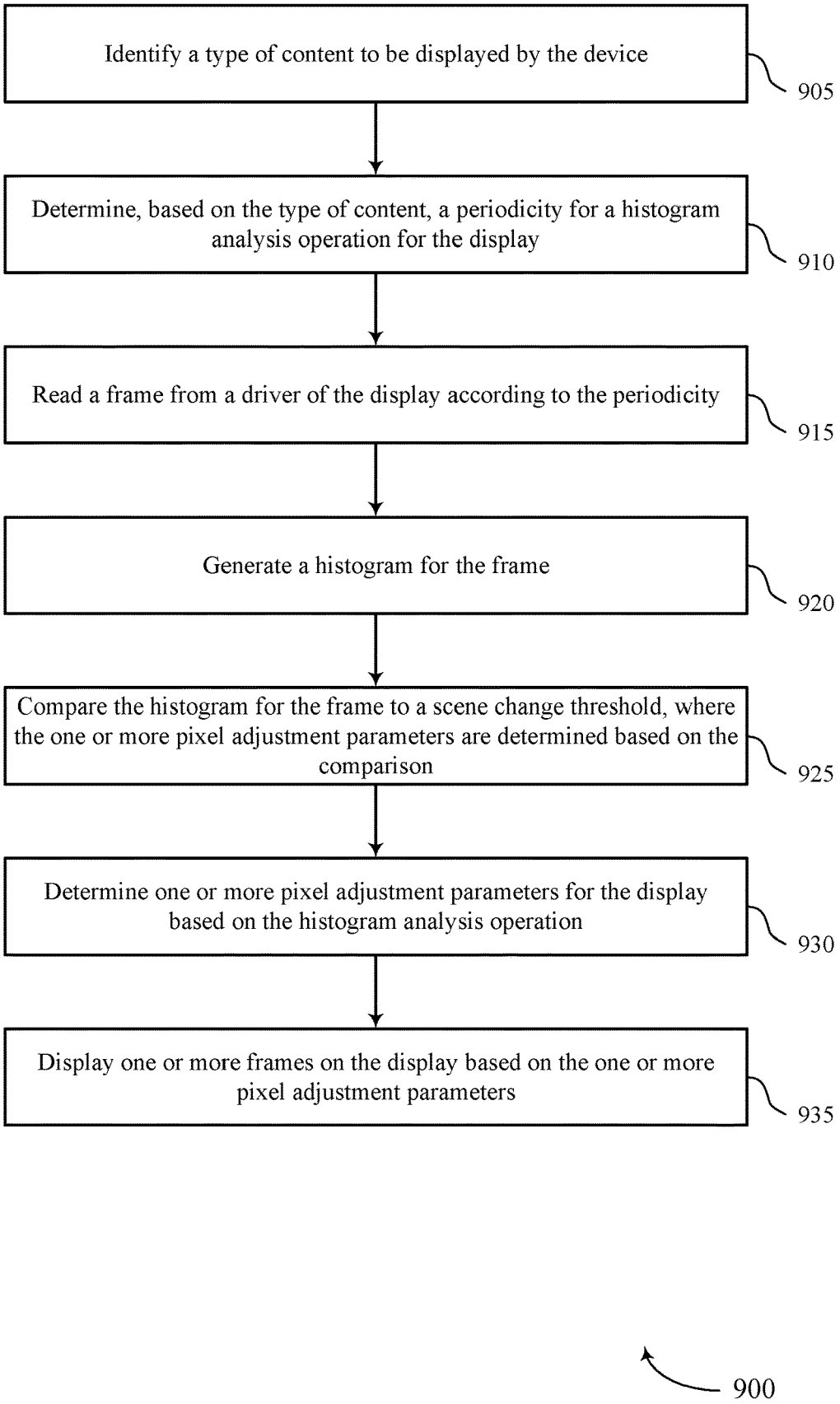

FIG. 9 shows a flowchart illustrating a method 900 that supports histogram reads for efficient display post processing and improved power gains in accordance with aspects of the present disclosure. The operations of method 900 may be implemented by a device or its components as described herein. For example, the operations of method 900 may be performed by a display panel controller as described with reference to FIGS. 6 and 7. In some examples, a device may execute a set of instructions to control the functional elements of the device to perform the functions described below. Additionally or alternatively, a device may perform aspects of the functions described below using special-purpose hardware.

At 905, the device may identify a type of content to be displayed by the device. The operations of 905 may be performed according to the methods described herein. In some examples, aspects of the operations of 905 may be performed by a content manager as described with reference to FIG. 6.

At 910, the device may determine, based on the type of content, a periodicity for a histogram analysis operation for the display. The operations of 910 may be performed according to the methods described herein. In some examples, aspects of the operations of 910 may be performed by a periodicity manager as described with reference to FIG. 6.

At 915, the device may read a frame from a driver of the display according to the periodicity. The operations of 915 may be performed according to the methods described herein. In some examples, aspects of the operations of 915 may be performed by a histogram controller as described with reference to FIG. 6.

At 920, the device may generate a histogram for the frame. The operations of 920 may be performed according to the methods described herein. In some examples, aspects of the operations of 920 may be performed by a histogram controller as described with reference to FIG. 6.

At 925, the device may compare the histogram for the frame to a scene change threshold, where the one or more pixel adjustment parameters are determined based on the comparison. The operations of 925 may be performed according to the methods described herein. In some examples, aspects of the operations of 925 may be performed by a histogram controller as described with reference to FIG. 6.

At 930, the device may determine one or more pixel adjustment parameters for the display based on the histogram analysis operation. The operations of 930 may be performed according to the methods described herein. In some examples, aspects of the operations of 930 may be performed by a pixel adjustment manager as described with reference to FIG. 6.

At 935, the device may display one or more frames on the display based on the one or more pixel adjustment parameters. The operations of 935 may be performed according to the methods described herein. In some examples, aspects of the operations of 935 may be performed by a frame manager as described with reference to FIG. 6.

Figure 10:
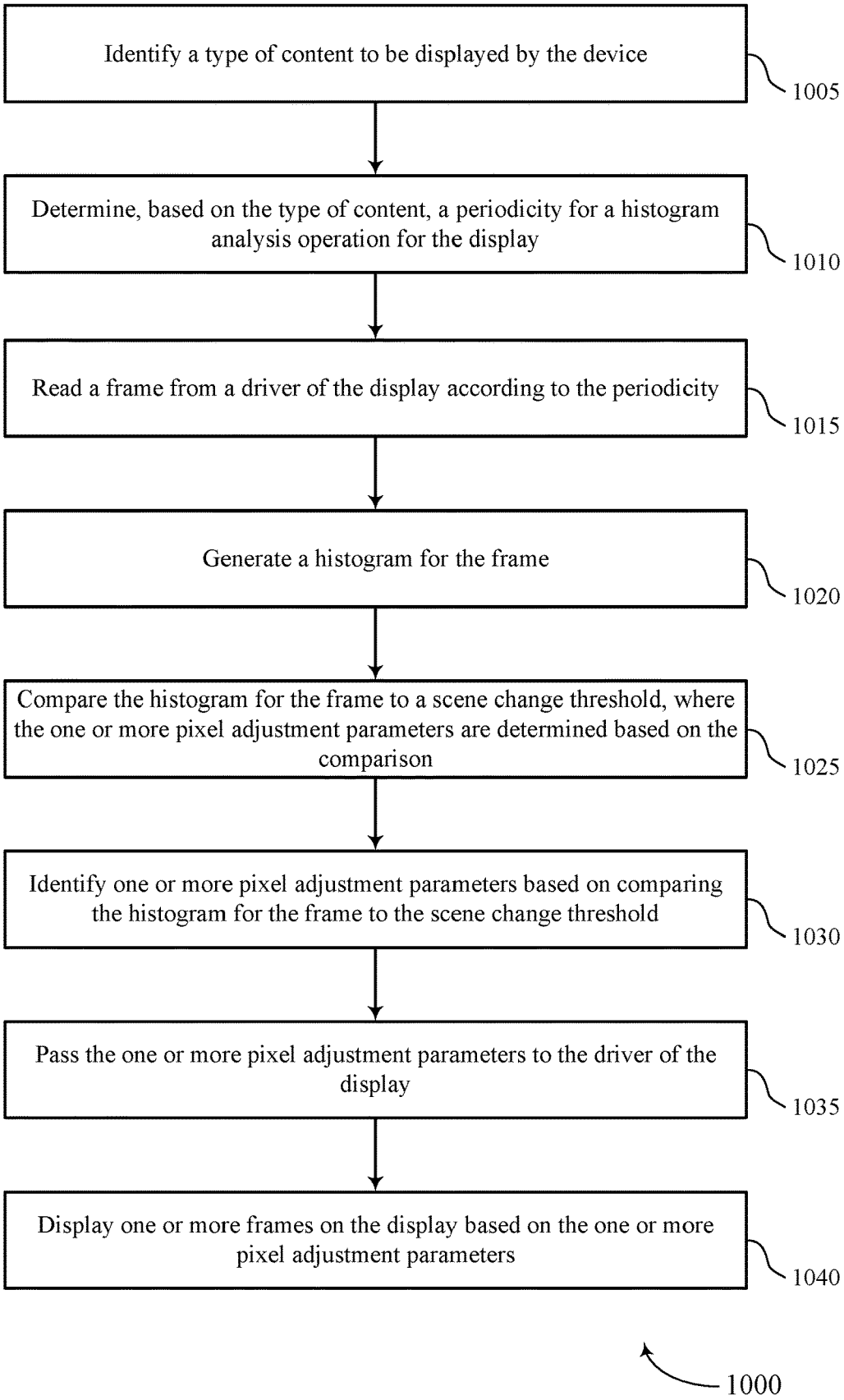

FIG. 10 shows a flowchart illustrating a method 1000 that supports histogram reads for efficient display post processing and improved power gains in accordance with aspects of the present disclosure. The operations of method 1000 may be implemented by a device or its components as described herein. For example, the operations of method 1000 may be performed by a display panel controller as described with reference to FIGS. 6 and 7. In some examples, a device may execute a set of instructions to control the functional elements of the device to perform the functions described below. Additionally or alternatively, a device may perform aspects of the functions described below using special-purpose hardware.

At 1005, the device may identify a type of content to be displayed by the device. The operations of 1005 may be performed according to the methods described herein. In some examples, aspects of the operations of 1005 may be performed by a content manager as described with reference to FIG. 6.

At 1010, the device may determine, based on the type of content, a periodicity for a histogram analysis operation for the display. The operations of 1010 may be performed according to the methods described herein. In some examples, aspects of the operations of 1010 may be performed by a periodicity manager as described with reference to FIG. 6.

At 1015, the device may read a frame from a driver of the display according to the periodicity. The operations of 1015 may be performed according to the methods described herein. In some examples, aspects of the operations of 1015 may be performed by a histogram controller as described with reference to FIG. 6.

At 1020, the device may generate a histogram for the frame. The operations of 1020 may be performed according to the methods described herein. In some examples, aspects of the operations of 1020 may be performed by a histogram controller as described with reference to FIG. 6.

At 1025, the device may compare the histogram for the frame to a scene change threshold, where the one or more pixel adjustment parameters are determined based on the comparison. The operations of 1025 may be performed according to the methods described herein. In some examples, aspects of the operations of 1025 may be performed by a histogram controller as described with reference to FIG. 6.

At 1030, the device may identify the one or more pixel adjustment parameters based on comparing the histogram for the frame to the scene change threshold. The operations of 1030 may be performed according to the methods described herein. In some examples, aspects of the operations of 1030 may be performed by a pixel adjustment manager as described with reference to FIG. 6.

At 1035, the device may pass the one or more pixel adjustment parameters to the driver of the display. The operations of 1035 may be performed according to the methods described herein. In some examples, aspects of the operations of 1035 may be performed by a pixel adjustment manager as described with reference to FIG. 6.

At 1040, the device may display one or more frames on the display based on the one or more pixel adjustment parameters. The operations of 1040 may be performed according to the methods described herein. In some examples, aspects of the operations of 1040 may be performed by a frame manager as described with reference to FIG. 6.

It should be noted that the methods described above describe possible implementations, and that the operations and the steps may be rearranged or otherwise modified and that other implementations are possible. Further, aspects from two or more of the methods may be combined. In some cases, one or more operations described above (e.g., with reference to FIGS. 8 through 10) may be omitted or adjusted without deviating from the scope of the present disclosure. Thus the methods described above are included for the sake of illustration and explanation and are not limiting of scope.

The various illustrative blocks and modules described in connection with the disclosure herein may be implemented or performed with a general-purpose processor, a DSP, an ASIC, a FPGA or other programmable logic device (PLD), discrete gate or transistor logic, discrete hardware components, or any combination thereof designed to perform the functions described herein. A general-purpose processor may be a microprocessor, but in the alternative, the processor may be any conventional processor, controller, microcontroller, or state machine. A processor may also be implemented as a combination of computing devices (e.g., a combination of a DSP and a microprocessor, multiple microprocessors, one or more microprocessors in conjunction with a DSP core, or any other such configuration).

The functions described herein may be implemented in hardware, software executed by a processor, firmware, or any combination thereof. If implemented in software executed by a processor, the functions may be stored on or transmitted over as one or more instructions or code on a computer-readable medium. Other examples and implementations are within the scope of the disclosure and appended claims. For example, due to the nature of software, functions described above can be implemented using software executed by a processor, hardware, firmware, hardwiring, or combinations of any of these. Features implementing functions may also be physically located at various positions, including being distributed such that portions of functions are implemented at different physical locations.

Computer-readable median includes both non-transitory computer storage media and communication median including any medium that facilitates transfer of a computer program from one place to another. A non-transitory storage medium may be any available medium that can be accessed by a general purpose or special purpose computer. By way of example, and not limitation, non-transitory computer-readable media may comprise RAM, ROM, EEPROM, flash memory, CD-ROM or other optical disk storage, magnetic disk storage or other magnetic storage devices, or any other non-transitory medium that can be used to carry or store desired program code means in the form of instructions or data structures and that can be accessed by a general-purpose or special-purpose computer, or a general-purpose or special-purpose processor. Also, any connection is properly termed a computer-readable medium. For example, if the software is transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium. Disk and disc, as used herein, include CD, laser disc, optical disc, digital versatile disc (DVD), floppy disk and Blu-ray disc where disks usually reproduce data magnetically, while discs reproduce data optically with lasers. Combinations of the above are also included within the scope of computer-readable media.

As used herein, including in the claims, "or" as used in a list of items (e.g., a list of items prefaced by a phrase such as "at least one of" or "one or more of") indicates an inclusive list such that, for example, a list of at least one of A, B, or C means A or B or C or AB or AC or BC or ABC (i.e., A and B and C). Also, as used herein, the phrase "based on" shall not be construed as a reference to a closed set of conditions. For example, an exemplary step that is described as "based on condition A" may be based on both a condition A and a condition B without departing from the scope of the present disclosure. In other words, as used herein, the phrase "based on" shall be construed in the same manner as the phrase "based at least in part on."

In the appended figures, similar components or features may have the same reference label. Further, various components of the same type may be distinguished by following the reference label by a dash and a second label that distinguishes among the similar components. If just the first reference label is used in the specification, the description is applicable to any one of the similar components having the same first reference label irrespective of the second reference label, or other subsequent reference label.

The description set forth herein, in connection with the appended drawings, describes example configurations and does not represent all the examples that may be implemented or that are within the scope of the claims. The term "exemplary" used herein means "serving as an example, instance, or illustration," and not "preferred" or "advantageous over other examples." The detailed description includes specific details for the purpose of providing an understanding of the described techniques. These techniques, however, may be practiced without these specific details. In some instances, well-known structures and devices are shown in block diagram form in order to avoid obscuring the concepts of the described examples.

The description herein is provided to enable a person skilled in the art to make or use the disclosure. Various modifications to the disclosure will be readily apparent to those skilled in the art, and the generic principles defined herein may be applied to other variations without departing from the scope of the disclosure. Thus, the disclosure is not limited to the examples and designs described herein, but is to be accorded the broadest scope consistent with the principles and novel features disclosed herein.

What is claimed is:

1. A method for refreshing a display of a device, comprising:

identifying a type of content to be displayed by the device;

determining a scene change rate for the type of content by analyzing a plurality of histograms, wherein each histogram is associated with a respective frame of the type of content;

determining, based at least in part on the type of content and the scene change rate, a periodicity for a histogram analysis operation for the display;

performing the histogram analysis operation according to the periodicity;

determining one or more pixel adjustment parameters for the display based at least in part on the histogram analysis operation; and displaying one or more frames on the display based at least in part on the one or more pixel adjustment parameters.

2. The method of claim 1, wherein identifying the type of content comprises:

identifying an application associated with the type of content in a list of applications, wherein each application in the list of applications is associated with a respective periodicity of the histogram analysis operation.

3. The method of claim 2, further comprising:

generating the list of applications and the respective periodicities by analyzing a plurality of histograms for each application in the list of applications.

4. The method of claim 1, wherein the type of content comprises first pixels that change between adjacent frames and second pixels that do not change between the adjacent frames, the first pixels being smaller in quantity than the second pixels.

5. The method of claim 1, wherein performing the histogram analysis operation according to the periodicity comprises:

reading a frame from a driver of the display according to the periodicity;

generating a histogram for the frame; and comparing the histogram for the frame to a scene change threshold, wherein the one or more pixel adjustment parameters are determined based at least in part on the comparison.

6. The method of claim 5, further comprising:

determining the scene change threshold based at least in part on the type of content, wherein comparing the histogram for the frame to the scene change threshold is based at least in part on determining the scene change.

7. The method of claim 5, wherein generating the histogram for the frame comprises:

generating a spread of brightness values for pixels of the frame; and determining a representative value for the frame based at least in part on the spread of brightness values, wherein comparing the histogram for the frame to the scene change threshold comprises comparing the representative value for the frame to the scene change threshold.

8. The method of claim 5, wherein determining the one or more pixel adjustment parameters comprises:

identifying the one or more pixel adjustment parameters based at least in part on comparing the histogram for the frame to the scene change threshold; and passing the one or more pixel adjustment parameters to the driver of the display.

9. The method of claim 1, wherein the one or more pixel adjustment parameters comprise a backlight reduction value, a pixel boosting value, a pixel intensity value, a pixel reduction value, or a combination thereof.

10. The method of claim 1, wherein the periodicity spans a group of frames that is associated with the type of content.

11. An apparatus, comprising:

a processor, memory in electronic communication with the processor; and instructions stored in the memory and executable by the processor to cause the apparatus to:

identify a type of content to be displayed by the apparatus;

determine a scene change rate for the type of content by analyzing a plurality of histograms, wherein each histogram is associated with a respective frame of the type of content;

determine, based at least in part on the type of content and the scene change rate, a periodicity for a histogram analysis operation for a display;

perform the histogram analysis operation according to the periodicity;

determine one or more pixel adjustment parameters for the display based at least in part on the histogram analysis operation; and display one or more frames on the display based at least in part on the one or more pixel adjustment parameters.

12. The apparatus of claim 11, wherein the instructions to identify the type of content are executable by the processor to cause the apparatus to:

identify an application associated with the type of content in a list of applications, wherein each application in the list of applications is associated with a respective periodicity of the histogram analysis operation.

13. The apparatus of claim 12, wherein the instructions to perform the histogram analysis operation according to the periodicity are executable by the processor to cause the apparatus to:

read a frame from a driver of the display according to the periodicity;

generate a histogram for the frame; and compare the histogram for the frame to a scene change threshold, wherein the one or more pixel adjustment parameters are determined based at least in part on the comparison.

14. The apparatus of claim 13, wherein the instructions to determine the one or more pixel adjustment parameters are executable by the processor to cause the apparatus to:

identify the one or more pixel adjustment parameters based at least in part on comparing the histogram for the frame to the scene change threshold; and pass the one or more pixel adjustment parameters to the driver of the display.

15. An apparatus, comprising:

means for identifying a type of content to be displayed by the apparatus;

means for determining a scene change rate for the type of content by analyzing a plurality of histograms, wherein each histogram is associated with a respective frame of the type of content;

means for determining, based at least in part on the type of content and the scene change rate, a periodicity for a histogram analysis operation for a display;

means for performing the histogram analysis operation according to the periodicity;

means for determining one or more pixel adjustment parameters for the display based at least in part on the histogram analysis operation; and means for displaying one or more frames based at least in part on the one or more pixel adjustment parameters.

16. The apparatus of claim 15, wherein the means for identifying the type of content comprises:

means for identifying an application associated with the type of content in a list of applications, wherein each application in the list of applications is associated with a respective periodicity of the histogram analysis operation.

17. The apparatus of claim 15, wherein the means for performing the histogram analysis operation according to the periodicity comprises:

means for reading a frame from a driver of the display according to the periodicity;

means for generating a histogram for the frame; and means for comparing the histogram for the frame to a scene change threshold, wherein the one or more pixel adjustment parameters are determined based at least in part on the comparison.

* * * * *